US005603807A

United States Patent [19]

Heinzmann

[11] Patent Number: 5,603,807

[45] Date of Patent: Feb. 18, 1997

[54] PAPER MACHINE HEADBOX WITH LONGITUDINALLY SHIFTABLE CONTOURED WALL

[75] Inventor: Helmut Heinzmann, Böhmenkirch, Germany

[73] Assignee: J. M. Voith GmbH, Heidenheim, Germany

[21] Appl. No.: 498,501

[22] Filed: Jul. 5, 1995

Related U.S. Application Data

[63] Continuation of Ser. No. 157,717, Nov. 24, 1993, abandoned.

[30] Foreign Application Priority Data

Nov. 26, 1992 [DE] Germany ..... 42 39 644.1

[51] Int. Cl.[6] ..... D21F 1/06

[52] U.S. Cl. ..... 162/343; 162/336; 162/216

[58] Field of Search ..... 162/336, 343, 162/344, 216

[56] References Cited

U.S. PATENT DOCUMENTS

| | | | |
|---|---|---|---|
| 3,843,470 | 10/1974 | Betley et al. | 162/343 |
| 3,939,037 | 2/1976 | Hill | 162/343 |
| 3,954,558 | 5/1976 | Egelhof | 162/336 |
| 4,133,713 | 1/1979 | Chuang | 162/216 |
| 4,326,916 | 4/1982 | Flaig et al. | 162/344 |
| 4,504,360 | 3/1985 | Fujiwara | 162/343 |
| 4,566,945 | 1/1986 | Ewald et al. | 162/336 |
| 4,604,164 | 8/1986 | Fujiwara et al. | 162/343 |
| 4,687,548 | 8/1987 | Ilmoniemi et al. | 162/216 |
| 4,765,868 | 8/1988 | Fujiwara | 162/344 |
| 4,888,094 | 12/1989 | Weisshuhn et al. | 162/198 |
| 4,897,158 | 1/1990 | Weisshuhn et al. | 162/259 |
| 4,898,643 | 2/1990 | Weisshuhn et al. | 162/259 |

FOREIGN PATENT DOCUMENTS

3535849A1 4/1987 Germany .

OTHER PUBLICATIONS

"Der Einfluß des Stoffauflaufes auf Asymmetriefehler im Papier" by D. Egelhof Heidenheim, Sonderdruck aus Das Papier Nr. 7/86, Seite 313–318, pp. 2–7.

"Uber die Messung der Faserorientierung in einem Papierblatt mittels Laserstrahlung," by W. Bauer, et al., *Wochenblatt Fur Papierfabrikation,* 1988, pp. 461–462, 464–466 and 468.

*Primary Examiner*—Karen M. Hastings

*Attorney, Agent, or Firm*—Marshall, O'Toole, Gerstein, Murray & Borun

[57] ABSTRACT

A headbox of a machine for producing a fiber web from a pulp suspension which travels in a flow direction through the headbox has a first chamber into which a pulp suspension is introduced, a second chamber provided downstream of the first chamber, and at least two walls provided in a region between the first and second chambers so that the pulp suspension flows between the two walls. Each of the two walls has a non-planar, contoured surface to generate turbulence in the pulp suspension flowing between the two walls. The headbox also includes means for longitudinally shifting at least one of the two walls with respect to the other wall to control the turbulence generated in the pulp suspension.

14 Claims, 2 Drawing Sheets

Fig. 3a
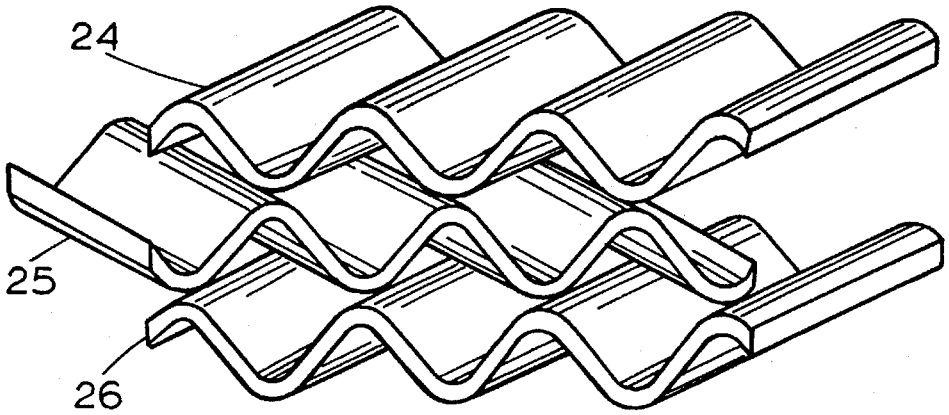
Fig 3b
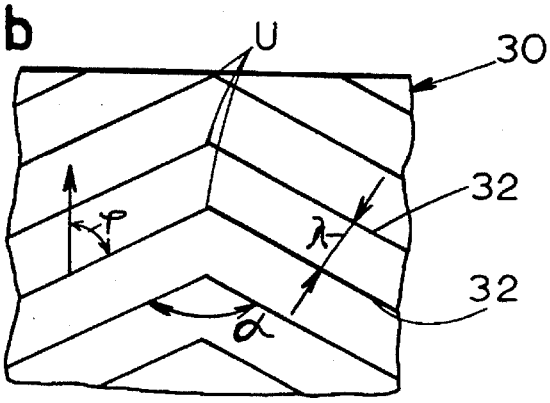
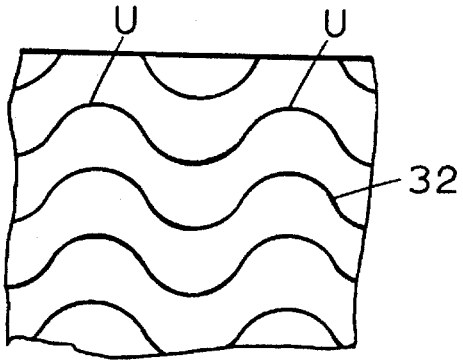
Fig. 3d
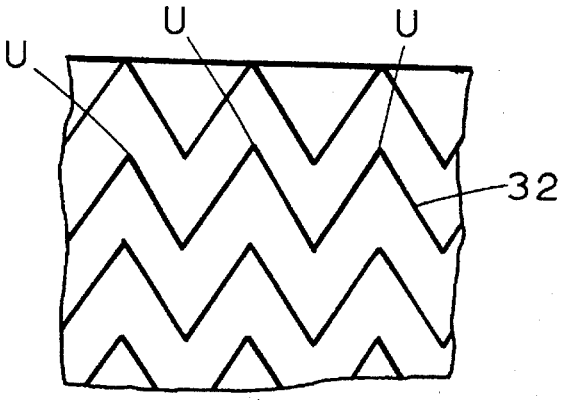
Fig. 3c

PAPER MACHINE HEADBOX WITH LONGITUDINALLY SHIFTABLE CONTOURED WALL

This is a Continuation of U.S. application Ser. No. 08/157,717, filed Nov. 24, 1993, now abandoned.

BACKGOUND OF THE INVENTION

The invention is directed to a headbox for making a web of material, from a pulp suspension, having a number of contoured walls provided therein to generate turbulence in the flow of pulp suspension within the headbox.

U.S. Pat. No. 4,504,360 to Fujiwara discloses a headbox for a paper machine having a turbulence insert which is supposed to produce paper with as uniform quality as possible. The turbulence insert consists essentially of plates of different thicknesses which run along the width of the paper machine between the upper and lower lips of the headbox. The thinner and thicker sections of the plates and the stirfaces of the upper and lower lips are designed in such a way that the flow cross-section decreases continuously in the channel of the headbox tinder consideration and is the same all along the width of the machine so that steady acceleration or slowing down of the pulp suspension is achieved. As a result of this, an attempt is made to separate the does present in the pulp suspension. A disadvantage of the Fujiwara structure is that adjustment of the headbox to different pulp compositions and machine velocities is possible only to a limited extent.

A problem in the production of paper with as uniform structure and thickness as well as fiber orientation over the entire machine width lies in the consistency of the pulp suspension from which the paper is manufactured. The pulp suspension for paper production contains long fibers which have a tendency to form flocs, as a result of which changes in density will occur in the produced paper web. In addition, long fibers tend to align in the direction of flow, so that the paper web produced has different tensile strength in the longitudinal and transverse directions of the paper. Satisfactory dispersion of the fibers can be achieved by the use of turbulent flow.

SUMMARY OF THE INVENTION

The present invention is directed to an improved headbox for a machine for producing a fiber web, such as a paper web, from a pulp suspension which travels in a flow direction through the headbox. In one aspect, the headbox includes a first chamber into which the pulp suspension is introduced, a second chamber provided downstream of the first chamber, and at least two walls provided in a region between the first and second chambers. The two walls have non-planar, contoured surfaces to generate turbulence in the pulp suspension flowing between them. The headbox also has means for shifting at least one of the two walls with respect to the other wall to control the turbulence of the pulp suspension flowing between the two walls.

In a second aspect, the invention is directed to a headbox having a first chamber into which the pulp suspension is introduced, a second chamber provided downstream of the first chamber, and at least two walls provided in a region between the first and second chainbets. The two walls have non-planar, contoured stirfaces with a number of lines of minima and maxima formed on each surface. The two walls are disposed at a relative position to each other such that the lines of minima and maxima form an angle different from 0° and 180° with respect to each other so that the pulp suspension flowing between the walls undergoes a change in direction.

Due to the turbulence in the pulp suspension generated by the non-planar, contoured surfaces of the walls in the headbox, the dispersion of paper fibers is improved, and the mechanical properties of the resultant paper web will show as little difference as possible in the transverse and longitudinal directions. The ability to shift one of the contoured walls with respect to the other allows adjustment of the paper machine speed and pulp suspension properties in a simple manner.

The contoured walls described above can be used in a headbox as a turbulence insert, as a tube distribution grid or as a combination of tube distribution grid and turbulence insert. Naturally, the contoured walls can be used in a headbox with or without damping attachment and in a headbox with only a flow grid.

One of the two walls of the headbox may have a cross-section with a plurality of maximum-width portions including a first maximum-width portion and a second maximum-width portion and a plurality of minimum-width portions including a first minimum-width portion and a second minimum-width portion, with the maximum-width portions altemating with the minionurn-width portions. The first maximum-width portion is disposed upstream of the second maximum-width portion. The first maximum-width portion has a first width, and the second maximum-width portion has a second width, with the first width being greater than the second width. The first minimum-width portion is disposed upstream of the second minimum-width portion. The first minimum-width portion has a third width, and the second minimum-width portion has a fourth width, the third width being greater than the fourth width, and each of the minimum-width portions has a concavely curved surface and each of the maximum-width portions has a convexly curved surface.

These and other features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 3*a* is a partial perspective view of the internal strncture of a headbox with corrugated plates arranged inclined to the flow direction; and FIGS. 3*b*–3*d* are top views of several corrugated structure designs for a headbox based oil the minima or maxima lines of the turbulence inserts according to the invention.

BRIEF DESCRIPTION OF THE PREFERRED EMBODIMENTS

Figure 1:
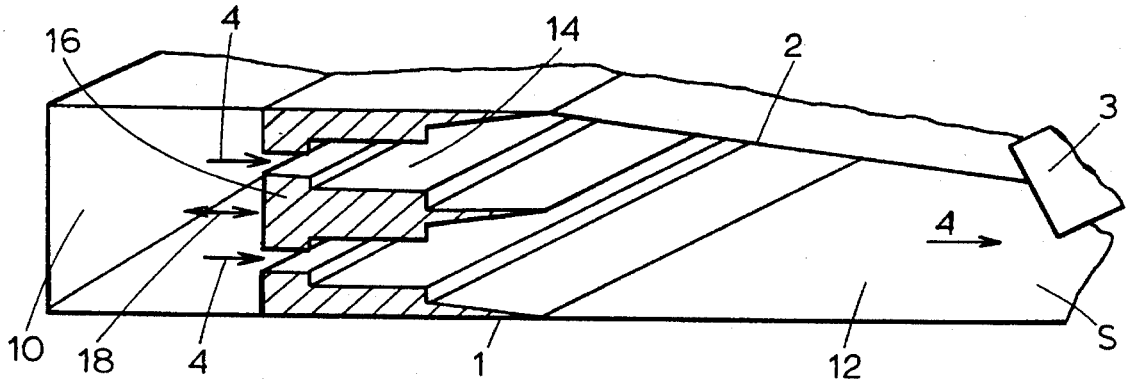
FIG. 1 is a cross-sectional view of an embodiment of a headbox in accordance with the invention having a stepwise turbulence insert.

FIG. 1 illustrates a cross-section of one embodiment of a headbox for a paper-making machine. The headbox includes a bottom wall or plate 1 and a cover wall or plate 2 disposed over the bottom plate 1. The botton plate 1 and the cover plate 2, together with the sidewalls of the headbox, define a first fiuid chamber 10 shown in the left-hand portion of FIG.

1 and a second fluid chamber 12, shown in the right-hand portion of FIG. 1, in fluid communication with the first fluid chamber 10.

In the second fluid chamber 12, the bottom plate 1 and the cover plate 2 together form a nozzle which narrows downstream (towards the right in FIG. 1). A movable diaphragm or plate 3 is disposed adjacent the end of the cover plate 2 at the fight-hand end of the second chamber 12. The space between the bottom edge of the plate 3 and the bottom plate 1 constitutes a discharge slit S. The plate 3, which extends the entire width of the headbox, may be shifted in a direction parallel to its orientation as shown in FIG. 1 to control the size of the discharge slit S.

The headbox includes a middle region 14 disposed between the first chamber 10 and the second chamber 12. In the region 14, the thickness of the bottom and cover plates 1, 2 varies in a stepwise manner in three steps, to form non-planar, contoured walls, in such a way that the plate thickness decreases downstream (to the right in FIG. 1) so that the cross-section of the region 14 between the plates 1, 2, which is occupied by the pulp suspension, increases downstream. A middle wall or plate 16 is disposed between the stepwise-portions of the bottom and cover plates 1, 2. The middle plate 16 has two surfaces, each of which comprises a non-planar, contoured surface having three step-wise changes.

During operation of the headbox, the pulp suspension, which is introduced in the first chamber 10 via a fiuid inlet (not shown), flows in the direction indicated by arrows 4 from the first chamber 10 through the middle region 14 to the second chamber 12 and through the discharge slit S after which it is pressed and dried in a conventional manner to form a web, such as a paper web. Due to their non-planar, contoured surfaces, the plates 1, 2, 16 generate turbulence in the flow of pulp suspension as it passes through the middle region 14. The turbulence so produced tends to result in a more random alignment of the fibers in the pulp suspension and to reduce the fonnation of flocs in the pulp suspension, thus resulting in a finished web that is more uniform in the longitudinal and transverse directions.

The middle plate 16 is horizontally (e.g. longitudinally) shiftable with respect to the bottom and cover plates 1, 2 in the directions parallel to the direction of flow within the headbox as indicated by the arrow 18. The capability to shift the middle plate 16 is advantageous since it allows the turbulence generated by the plates 1, 2, 16 to be adjusted or controlled. Shifting the plate 16 with respect to the plates 1, 2 changes the turbulence generated in the pulp suspension since it changes the cross-sectional area through which the pulp suspension flows.

The shifting of the middle plate 16 with respect to the other two plates 1, 2 is controlled by a hydraulic cylinder 20 (see FIG. 2) which is connected to the middle plate 16 via a rod member 22. The particular type of shifting means utilized is not important to the invention.

Figure 2:
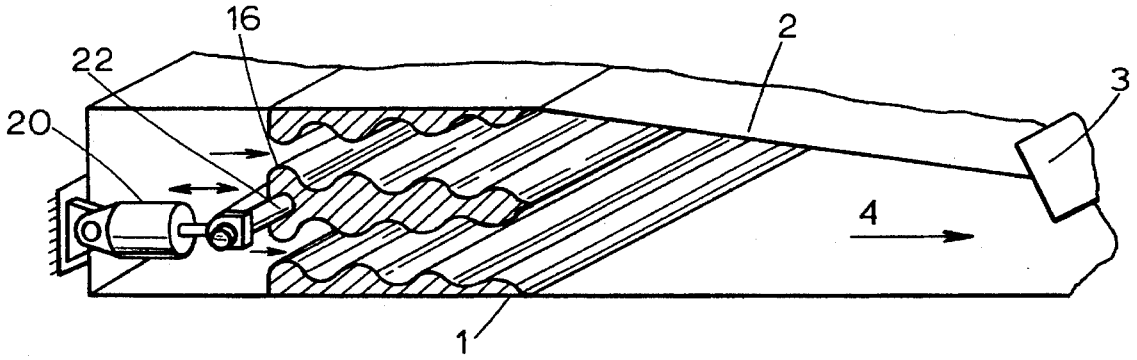
FIG. 2 is a cross-sectional view of a second embodiment of a headbox having a wavy turbulence insert.

FIG. 2 illustrates an alternative embodiment of a headbox in which the stirfaces of the plates 1, 2, 16 are corrugated to have alternating protmsions and recesses, instead of having step-wise changes in shape. In FIG. 2, the corrugated surfaces of the plates 1, 2, 16 are positioned with respect to each other so that there is a phase shift of $\lambda/2$ between them, where $\lambda$ is the wavelength of the corrugation pattern of the surfaces. In particular, the $\lambda/2$ phase shift causes the protrusions of each plate to be aligned together and the recesses to be aligned together so that the cross-sectional flow area between the plates 1, 2, 16 increases and decreases to a large extent to produce alternate acceleration and deceleration of the pulp suspension. Naturally, the plate 16 could be shifted so as to provide no phase shift between the plates 1, 2, 16. In this case, each recess on a plate would be aligned with a protrusion on its adjacent plate so that the cross-sectional flow area between the plates 1, 2, 16 would not increase and decrease. If the plates 1, 2, 16 are provided with no phase shift, or in phase, the distance between the plates 1, 2, 16 can be reduced so that the plates 1, 2, 16 will "mesh." Furthermore, it is possible to choose the thickness of the plates 1, 2, 16 so that they will converge or diverge in the direction of flow.

FIG. 3*a* shows the internal structure of a headbox in which three plates 24, 25, 26 are arranged on top of one another. Each of the plates 24, 25, 26 has corrugated stirfaces in which parallel lines of minima and maxima are fonned. The plates 24, 25, 26 are disposed within the headbox (in the middle region 14 between the first and second chambers 10, 12, which are not shown in FIG. 3*a* for purposes of simplicity) at a relative position to each other such that the lines of minima and maxima of one stirface of a plate fonn an angle different from 0° and 180° with respect to the lines of minima and maxima of the adjacent surface of another plate (i.e., the lines of maxima and minima of adjacent plate surfaces are not parallel) so that the pulp suspension flowing between the plates 24, 25, 26 undergoes a change in direction. The upper and lower plates 24, 26 are aligned so that the lines of minima and maxima of those plates 24, 26 are parallel to each other. In order to avoid the development of fiber flocs, a distance is provided between the individual plates 24, 25, 26, which prevents the plates from lying directly on one another.

FIG. 3*b* illustrates a schematic top view (or bottom view) of an alternative embodiment of a corrugated plate 30 which can be used in the headbox embodiments of FIGS. 1 or 2. The lines of maxima (or minima) of the corrugated plate 30, which are designated 32, are spaced one wavelength $\lambda$ apart. The maxima 32 are generally parallel to each other, except that their direction changes at a number of reversal points U. The extent to which the direction of the maxima change at the reversal points U is designated with the angle $\alpha$, and the direction of the lines of maxima 32 (on the left-hand side of FIG. 3*b*) with respect to the flow direction is indicated by angle $\rho$. The shape of the lines of maxima 32 of the plate 30 resembles a chevron. It should be contemplated that the plate 30 of FIG. 3*b* could be used in a headbox with a similar plate 30, except that the two plates could be rotated 180° with respect to each other, so that the chevron structure of each plate would point in the opposite direction.

FIGS. 3*c* and 3*d* illustrate a schematic top view (or bottom view) of several alternative embodiments of a corrugated plate 30 which can be used in the headbox embodiments of FIGS. 1 or 2. The plate of FIG. 3*c* is generally similar to the plate illustrated in FIG. 3*b*, except that the plate of FIG. 3*c* has multiple reversal points U situated along its width so that the lines of maxima 32 form a zig-zag. The plate of FIG. 3*d* also has multiple reversal points, but the lines of maxima 32 are curved instead of being provided in a number of straight segments. In such a design, it is also advantageous that structures of this type create additional stabilization of the main flow direction of the liquid.

The headbox described above could be provided with additional features, such as replaceable plates which can be removed frown the headbox for replacement with new plates. The headbox could be provided with a mixer to mix the pulp suspension prior to its passing through the middle region 14. The mixer could be provided with means for throughput regulation.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A beadbox of a machine for producing a fiber web from a pulp suspension which travels in a flow direction through said headbox, said headbox comprising:

a first chamber into which a pulp suspension is introduced;

a second chamber in fluid communication with said first chamber, said second chamber being provided downstream of said first chamber;

two walls provided in a region between said first chamber and said second chamber so that said pulp suspension flows between said two walls, one of said two walls having a non-planar, contoured surface to generate turbulence in the pulp suspension flowing between said two walls, said one of said walls having a cross-section with a plurality of maximum-width portions including a first maximum-width portion and a second maximum-width portion and a plurality of minimum-width portions including a first minimum-width portion and a second minimum-width portion, said maximum-width portions alternating with said minimum-width portions, said first maximum-width portion being disposed upstream of said second maximum-width portion, said first maximum-width portion having a first width and said second maximum-width portion having a second width, said first width being greater than said second width, said first minimum-width portion being disposed upstream of said second minimum-width portion, said first minimum-width portion having a third width and said second minimum-width portion having a fourth width, said third width being greater than said fourth width, each of said minimum-width portions having a concavely curved surface and each of said maximum-width portions having a convexly curved surface; and means for longitudinally shifting said one of said two walls with respect to the other of said two walls to control the turbulence generated in the pulp suspension between said two walls.

2. A headbox as defined in claim 1 wherein said second chamber is formed by a pair of walls on the top and bottom of said second chamber, said pair of walls converging in the direction of flow.

3. A headbox as defined in claim 1 wherein said shifting means comprises a hydraulic cylinder connected to said one of said two walls.

4. A headbox as defined in claim 1 wherein at least one of said two walls is replaceable.

5. A headbox as defined in claim 1 wherein said pulp suspension comprises a paper pulp suspension and where a web of paper is produced from said paper pulp suspension.

6. A headbox as defined in claim 1 wherein each of said two walls has a non-planar, contoured surface to generate turbulence in the pulp suspension flowing between said two walls and wherein each of said walls has a cross-section with a plurality of maximum-width portions including a first maximum-width portion and a second maximum-width portion and a plurality of minimum-width portions including a first minimum-width portion and a second minimum-width portion, said maximum-width portions alternating with said minimum-width portions, said first maximum-width portion being disposed upstream of said second maximum-width portion, said first maximum-width portion having a first width and said second maximum-width portion having a second width, said first width being greater than said second width, said first minimum-width portion being disposed upstream of said second minimum-width portion, said first minimum-width portion having a third width and said second minimum-width portion having a fourth width, said third width being greater than said fourth width, each of said minimum-width portions having a concavely curved surface and each of said maximum-width portions having a convexly curved surface.

7. A headbox of a machine for producing a fiber web from a pulp suspension which travelr in a flow direction through said headbox, said headbox comprising:

a first chamber into which a pulp suspension is introduced;

a second chamber in fluid communication with said first chamber, said second chamber being provided downstream of said first chamber;

two walls provided in a region between said first chamber and said second chamber so that said pulp suspension flows between said two walls, one of said two walls having a non-planar, contoured surface to generate turbulence in the pulp suspension flowing between said two walls, said non-planar contoured surface of said one of said two walls comprising a top or bottom surface shaped to have a plurality of lines of minima and a plurality of lines of maxima, each of said lines of minima having a reversal point and each of said lines of maxima having a reversal point; and means for longitudinally shifting said one of said two walls with respect to the other of said two walls to control the turbulence generated in the pulp suspension between said two walls.

8. A beadbox as definced in claim 7 wherein each of said lines of minima having a plurality of reversal points and of said lines of maxima having a plurality of reversal points.

9. A headbox as defined in claim 7 wherein said second chamber is formed by a pair of walls on the top and bottom of said second chamber, said pair of walls converging in the direction of flow.

10. A headbox as defined in claim 7 wherein said shifting means comprises a hydraulic cylinder connected to said one of said two walls.

11. A headbox as defined in claim 7 wherein at least one of said two walls is replaceable.

12. A headbox as defined in claim 7 wherein said pulp suspension comprises a paper pulp suspension and wherein a web of paper is produced from said paper pulp suspension.

13. A headbox as defined in claim 7 wherein each of said lines of minima comprises a pair of straight-line segments joined at an acute angle and wherein each of said lines of maxima comprises a pair of straight-line segments joined at an acute angle.

14. A headbox as defined in claim 7 wherein each of said lines of minima comprises a curved line and wherein each of said lines of maxima comprises a curved line.

* * * * *